US010068513B2

(12) United States Patent
Liu et al.

(10) Patent No.: US 10,068,513 B2
(45) Date of Patent: Sep. 4, 2018

(54) ELECTRONIC PAPER APPARATUS AND DRIVING METHOD THEREOF

(71) Applicant: E Ink Holdings Inc., Hsinchu (TW)

(72) Inventors: Chuen-Jen Liu, Taoyuan (TW); Li-Wei Chou, Taoyuan (TW); Jia-Hong Xu, Taoyuan (TW); Yu-Ming Lee, Taoyuan (TW); Chi-Mao Hung, Taoyuan (TW)

(73) Assignee: E Ink Holdings Inc., Hsinchu (TW)

( * ) Notice: Subject to any disclaimer, the term of this patent is extended or adjusted under 35 U.S.C. 154(b) by 365 days.

(21) Appl. No.: 14/809,274

(22) Filed: Jul. 26, 2015

(65) Prior Publication Data

US 2016/0042678 A1 Feb. 11, 2016

Related U.S. Application Data

(60) Provisional application No. 62/033,111, filed on Aug. 5, 2014.

(30) Foreign Application Priority Data

Apr. 29, 2015 (TW) ..... 104113700 A

(51) Int. Cl.
*G09G 3/20* (2006.01)

(52) U.S. Cl.
CPC ..... *G09G 3/20* (2013.01); *G09G 2300/04* (2013.01); *G09G 2310/08* (2013.01); (Continued)

(58) Field of Classification Search
CPC ..... G09G 3/344; G09G 2330/022
See application file for complete search history.

(56) References Cited

U.S. PATENT DOCUMENTS 6,924,781 B1 8/2005 Gelbman
8,136,725 B2 3/2012 Yamazaki
(Continued)

FOREIGN PATENT DOCUMENTS

CN 101958103 1/2011
CN 103339821 10/2013

OTHER PUBLICATIONS

"Office Action of China Counterpart Application," dated May 31, 2017, p. 1-p. 6.

*Primary Examiner* — Sepehr Azari
(74) *Attorney, Agent, or Firm* — JCIPRNET

(57) ABSTRACT

An electronic paper apparatus including a communication module and a control module is provided. The communication module receives an electrical signal and generates a power voltage according to the electric signal. The communication module wakes up a controller during a first period of a work period by using the power voltage. The control module is electrically connected to the communication module, and includes the controller and an electronic paper display. The control module establishes a communication connection with the communication module during a second period of the work period. The power circuit module generates a driving voltage according to the power voltage to drive the electronic paper display to display image information according to the driving voltage during a display period. The first period and the second period are two continuous time intervals forming the work period. Furthermore, a driving method of the electronic paper apparatus is also provided.

19 Claims, 8 Drawing Sheets

(52) U.S. Cl.
CPC . *G09G 2330/022* (2013.01); *G09G 2330/026* (2013.01); *G09G 2370/16* (2013.01)

(56) References Cited

U.S. PATENT DOCUMENTS

| | | | | |
|---|---|---|---|---|
| 8,565,674 | B2 | 10/2013 | Seol et al. | |
| 2009/0283886 | A1* | 11/2009 | Yamazaki | G06K 19/0704 257/679 |
| 2010/0279606 | A1 | 11/2010 | Hillan et al. | |
| 2011/0012907 | A1* | 1/2011 | Sakamoto | G09G 3/344 345/555 |
| 2011/0279242 | A1 | 11/2011 | Krawczewicz | |
| 2012/0109735 | A1 | 5/2012 | Krawczewicz et al. | |
| 2012/0153742 | A1* | 6/2012 | Lee | G06K 19/0701 307/104 |
| 2012/0217303 | A1 | 8/2012 | Krawczewicz et al. | |
| 2013/0043979 | A1 | 2/2013 | Huang et al. | |
| 2013/0086389 | A1 | 4/2013 | Suwald | |
| 2013/0234532 | A1* | 9/2013 | Fells | H02J 5/005 307/104 |
| 2014/0045558 | A1 | 2/2014 | Kim | |
| 2014/0170975 | A1 | 6/2014 | Liao | |

* cited by examiner

ELECTRONIC PAPER APPARATUS AND DRIVING METHOD THEREOF

CROSS-REFERENCE TO RELATED APPLICATION

This application claims the priority benefits of U.S. provisional application Ser. No. 62/033,111, filed on Aug. 5, 2014 and Taiwan application serial no. 104113700, filed on Apr. 29, 2015. The entirety of each of the above-mentioned patent applications is hereby incorporated by reference herein and made a part of this specification.

BACKGROUND OF THE INVENTION

Field of the Invention

The invention relates to a display apparatus and a driving method thereof, and more particularly, to an electronic paper apparatus and a driving method thereof.

Description of Related Art

Nowadays, electronic cards (e.g., credit cards, badges, desktop cardboards) have been widely adopted to become one of indispensable electronic products for people in the modern life. For allowing the electronic card to provide diverse functions, a display panel may be disposed on the electronic card to display information associated with the electronic card, and the disposed display panel may be implemented by using an electronic paper display panel in order to satisfy demands for lower cost and lighter weight.

Generally, in related art, in order to update image information provided by the electronic paper display panel, it is required to wake up a control module inside an electronic paper apparatus in order to control overall operations of the electronic card. In related art, the control module is usually disposed with a plurality of charging capacitors. As such, in order to wake up the control module, a communication module inside the electronic paper apparatus needs to continuously input a plurality of pulse voltages to charge the charging capacitors, so that voltages of the charging capacitors are increased to a target voltage in a manner of step function. Subsequently, the target voltage may then be used to wake up a controller. In other words, a time required for waking up the controller in related art includes a charging time of the charging capacitors. In the related art, the charging time for the pulse voltages to increase the voltages of the charging capacitors to the target voltage is generally longer than a total of time lengths of a work period and a display period by, for example, twice as much. Accordingly, a time consumed for updating the image information of an electronic paper display is substantially increased.

SUMMARY OF THE INVENTION

The invention is directed to an electronic paper apparatus and a driving method thereof, which are capable of rapidly updating image information being displayed.

The electronic paper apparatus of the invention includes a communication module and a control module. The communication module receives an electrical signal and generates a power voltage according to the electric signal. The communication module wakes up a controller during a first period of a work period by using the power voltage. The control module is electrically connected to the communication module. The control module includes the controller and an electronic paper display. The control module establishes a communication connection with the communication module during a second period of the work period. Meanwhile, the control module generates a driving voltage according to the power voltage, so as to drive the electronic paper display to display image information according to the driving voltage during a display period. The first period and the second period are two continuous time intervals forming the work period.

In an embodiment of the invention, before the work period, the power voltage is maintained at a first voltage level. The power voltage is changed to a second voltage level to wake up the controller when the electrical signal is transmitted to the electronic paper apparatus by an image information providing apparatus.

In an embodiment of the invention, a time length for maintaining the power voltage at the first voltage level is greater than a time length of the first period.

In an embodiment of the invention, the communication module is configured to transmit the power voltage less than a threshold voltage to the control module via a first signal transmission path. The communication module is configured to transmit the power voltage greater than or equal to the threshold voltage to the control module via a second signal transmission path. The control module selects the power voltage less than the threshold voltage or the power voltage greater than or equal to the threshold voltage to drive the electronic paper display.

In an embodiment of the invention, the communication module includes an antenna module and a rectifying module. The antenna module is configured to electrically connect to the image information providing apparatus to receive the electrical signal. The rectifying module is electrically connected to the antenna module. The antenna module is configured to receive the electrical signal. The rectifying module rectifies the electrical signal to generate the power voltage to be provided to the control module.

In an embodiment of the invention, the rectifying module includes a first rectifier circuit and a second rectifier circuit. The first rectifier circuit is electrically connected to the antenna module and the control module. The first rectifier circuit is disposed on the first signal transmission path. The first rectifier circuit is configured to transmit the power voltage less than the threshold voltage to the control module. The second rectifier circuit is electrically connected to the antenna module and the control module. The second rectifier circuit is disposed on the second signal transmission path. The second rectifier circuit is configured to transmit the power voltage greater than or equal to the threshold voltage to the control module.

In an embodiment of the invention, the rectifying module further includes a communication circuit and a match circuit. The communication circuit is electrically connected to the antenna module and the control module. The communication circuit is configured to establish the communication connection with the control module during the second period of the work period. The communication circuit and the second rectifier circuit form a communication circuit block. The match circuit is electrically connected to the antenna module, the communication circuit block and the first rectifier circuit. The match circuit is configured to regulate impedances of the first rectifier circuit and the communication circuit block to achieve an impedance matching between the first rectifier circuit and the communication circuit block.

In an embodiment of the invention, the control module further includes a power circuit module. The power circuit module includes a regulator circuit and a driver circuit. The regulator circuit is electrically connected to the communication module, the controller and the electronic paper display. The regulator circuit is configured to select to output the power voltage less than the threshold voltage and the power voltage greater than or equal to the threshold voltage. The driver circuit is electrically connected to the regulator circuit, the controller and the electronic paper display. The driver circuit is configured to drive the electronic paper display to display the image information according to the power voltage less than the threshold voltage or the power voltage greater than or equal to the threshold voltage.

In an embodiment of the invention, the power circuit module further includes a soft-start circuit. The soft-start circuit is electrically connected to the regulator circuit and the driver circuit. The soft-start circuit is configured to receive the power voltage less than the threshold voltage or the power voltage greater than or equal to the threshold voltage, lower an inrush current of the power voltage and output the power voltage in which the inrush current is lowered to the driver circuit.

In an embodiment of the invention, the controller converts an analog signal into a digital signal. The controller detects an electrical property of the first signal transmission path and an electrical property of the second signal transmission path, and controls the regulator circuit to select the power voltage less than the threshold voltage or the power voltage greater than or equal to the threshold voltage by using the digital signal.

In an embodiment of the invention, the power circuit module further includes a charging battery and a charging circuit. The charging battery is electrically connected to the regulator circuit. The charging battery is configured to store the power voltage outputted by the regulator circuit. The charging circuit is electrically connected to the regulator circuit and the charging battery. The charging circuit is configured to receive the power voltage, and stores the power voltage to the charging battery.

In an embodiment of the invention, the communication module and the control module are integrated on one substrate and inseparable from each other.

In an embodiment of the invention, the communication module and the control module are disposed on different substrates and separable from each other.

A driving method of an electronic paper apparatus of the invention includes: receiving an electrical signal, generating a power voltage according to the electrical signal, and waking up the controller during a first period of a work period by using the power voltage; establishing a communication connection between the communication module and the controller during a second period of the work period; and generating a driving voltage according to the power voltage, so as to drive the electronic paper display to display image information according to the driving voltage during a display period. The first period and the second period are two continuous time intervals forming the work period.

In an embodiment of the invention, the driving method further includes: transmitting one of the power voltage less than a threshold voltage and the power voltage greater than or equal to the threshold voltage to the control module. The power voltage less than the threshold voltage is transmitted to the control module via a first signal transmission path. The power voltage greater than or equal to the threshold voltage is transmitted to the control module via a second signal transmission path.

In an embodiment of the invention, the electronic paper apparatus is configured to electrically connect to an image information providing apparatus. The step of receiving the electrical signal, generating the power voltage according to the electrical signal, and waking up the controller during the first period of the work period by using the power voltage includes: sensing the electrical signal provided by the image information providing apparatus; and rectifying the electrical signal in order to generate the power voltage to be provided to the control module to thereby wake up the controller.

In an embodiment of the invention, the driving method further includes: regulating impedances of the first signal transmission path and the second signal transmission path to achieve an impedance matching between the first signal transmission path and the second signal transmission path.

In an embodiment of the invention, the driving method further includes: lowering an inrush current of the power voltage, and outputting the power voltage in which the inrush current is lowered to the driver circuit. In the step of generating the driving voltage according to the power voltage, the driving voltage is generated according to the power voltage in which the inrush current is lowered.

In an embodiment of the invention, the driving method further includes: converting an analog signal into a digital signal; and selecting to output the power voltage less than the threshold voltage or the power voltage greater than or equal to the threshold voltage according to the digital signal.

In an embodiment of the invention, the driving method further includes: storing the power voltage to a charging circuit.

In an embodiment of the invention, before the work period, the power voltage is maintained at a first voltage level. When the power voltage enters the work period, the power voltage is changed to the second voltage level to wake up the controller.

In an embodiment of the invention, a time length for maintaining the power voltage at the first voltage level is greater than a time length of the first period.

Based on the above, in the embodiments of the invention, the communication module wakes up the controller of the control module during the first period, establishes the communication connection with the communication module during the second period and generates the driving voltage, and the two periods are the two continuous time intervals that form the work period. As a result, the image information displayed by the electronic paper apparatus may be rapidly updated.

To make the above features and advantages of the present disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
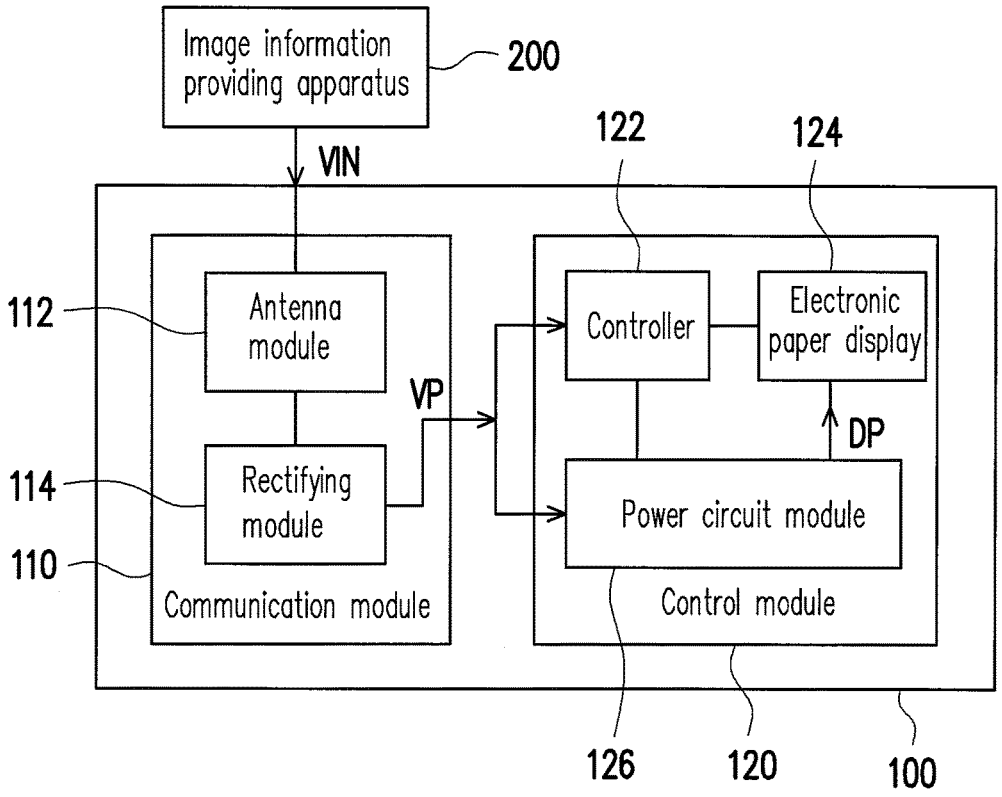
FIG. 1 is a schematic diagram illustrating an electronic paper apparatus and an image information providing apparatus according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
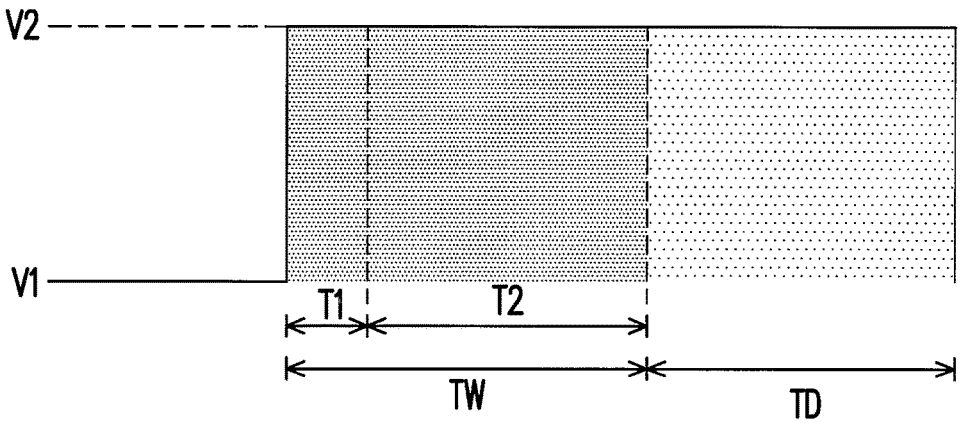
FIG. 2 is a schematic diagram illustrating waveforms of a power voltage according to an embodiment of the invention.

FIG. 1 is a schematic diagram illustrating an electronic paper apparatus and an image information providing apparatus according to an embodiment of the invention. FIG. 2 is a schematic diagram illustrating waveforms of a power voltage according to an embodiment of the invention. Referring to FIG. 1 and FIG. 2, an image information providing apparatus 200 of the present embodiment is configured to provide image information (not illustrated) and an electrical signal VIN to an electronic paper apparatus 100. Before a communication connection is established with the image information providing apparatus 200 by the electronic paper apparatus 100, the electrical signal VIN provided by the image information providing apparatus 200 may be, for example, configured to generate a power voltage VP through sensing. In the present embodiment, the power voltage VP may be configured to wake up a controller 122 of the electronic paper apparatus 100 so as to establish the communication connection with the image information providing apparatus 200. After the communication connection is established with the image information providing apparatus 200 by the electronic paper apparatus 100, the image information providing apparatus 200 may update the image information displayed by an electronic paper display 124. In the present embodiment, the operation of waking up the controller 122 of the electronic paper apparatus 100 by the image information providing apparatus 200 includes, for example, in an original state where the controller 122 is not working, starting to perform an overall system control on the electronic paper apparatus 100, or controlling each of components in the electronic paper apparatus 100 to execute the corresponding functional operation. In the present exemplary embodiment, the image information providing apparatus 200 is, for example, an electronic apparatus capable of providing the image information, such as a card reader or a handheld electronic apparatus, but formats of the image information providing apparatus 200 are not particularly limited in the invention.

Further, in the present embodiment, the controller 122 is, for example, a central processing unit (CPU) or other programmable microprocessors, a digital signal processor (DSP), a programmable controller, an application specific integrated circuits (ASIC), a programmable logic device (PLD) or other similar apparatuses.

In the present embodiment, the electronic paper apparatus 100 includes a communication module 110 and a control module 120. The control module 120 is electrically connected to the communication module 110. In the present embodiment, the communication module 110 is configured to receive the electrical signal VIN to thereby generate the power voltage VP, so that the power voltage VP may be outputted to the control module 120. In the present embodiment, the communication module 110 wakes up the controller 122 of the control module 120 during a first period T1 of a work period TW by using the power voltage VP so that the controller 122 may control each of the components to execute the corresponding functional operation, for example.

Specifically, the communication module 110 of the present embodiment includes an antenna module 112 and a rectifying module 114. The rectifying module 114 is electrically connected to the antenna module 112. The antenna module 112 is configured to electrically connect to the image information providing apparatus 200 to receive the electrical signal VIN. A method of generating the power voltage VP by the communication module 110 includes, for example, using a Near Field Communication (NFC) technology to sense the electrical signal VIN in order to generate the power voltage VP. In the present embodiment, the antenna module 112 includes, for example, an antenna in a metal coil form, or a printed patch antenna which is directly printed on a substrate. The forms of the antenna included by the antenna module 112 and a method of electrically connecting the antenna module 112 and the image information providing apparatus 200 are not particularly limited in the invention. Subsequently, the rectifying module 114 rectifies the electrical signal VIN so as to provide the rectified power voltage VP to the control module 120. In the present embodiment, the rectifying module 114 converts the electrical signal VIN in AC form into the power voltage VP in DC form, for example. Therefore, the rectifying module 114 includes, for example, at least one AC-to-DC converter.

In the present embodiment, the control module 120 is configured to drive the electronic paper display 124 to display the image information according to a driving voltage DP during a display period TD. Specifically, the control module 120 includes the controller 122, the electronic paper display 124 and a power circuit module 126. The controller 122 is configured to establish the communication connection with the communication module 110 during a second period T2 of the work period TW, and generate the driving voltage DP according to the power voltage VP. Subsequently, during the display period TD, the controller 122 is configured to control the power circuit module 126 to drive the electronic paper display 124, and update its display frame to be the image information provided by the image information providing apparatus 200.

Referring back to FIG. 2, what illustrated in FIG. 2 is, for example, a signal waveform of the power voltage VP outputted by the rectifying module 114. In the present embodiment, before the work period TW, the power voltage VP is, for example, maintained at a first voltage level V1. During the work period TW and the display period TD, the power voltage VP is, for example, maintained at a second voltage level V2. The work period TW includes the first period T1 and the second period T2. The first period T1 and the second period T2 are two continuous time intervals that form the work period TW. When the power voltage VP enters the work period TW, the power voltage VP is changed from the first voltage level V1 to the second voltage level V2. The second voltage level V2 with higher level may be configured to wake up the controller 122. In other words, while waking up the controller 122 and establishing the communication with the communication module 120, a voltage level of the power voltage VP is maintained at the continuous and stable second voltage level V2.

In the present embodiment, as shown in FIG. 2, when the power voltage VP enters the work period TW, the power voltage VP is changed from the first voltage level V1 to the second voltage level V2 to directly wake up the controller 122. Therefore, before the work period TW, the power voltage VP is maintained at the continuous and stable first voltage level V1 without including a plurality of pulse voltages. Also, in the present embodiment, a time length for maintaining the power voltage VP at the first voltage level V1 is, for example, greater than a time length of the first period T1, but the invention is not limited thereto. In the present embodiment, with respect to the method of waking up the controller 122 by changing from the first voltage level V1 to the second voltage level V2, an overall operating time does not need to include the charging time as required in the related art. Accordingly, the time consumed for updating the image information of the electronic paper display may be substantially reduced. In an embodiment, the time length of the first period T1 occupies, for example, approximately 5% of the work period TW, but the invention is not limited thereto.

Figure 3:
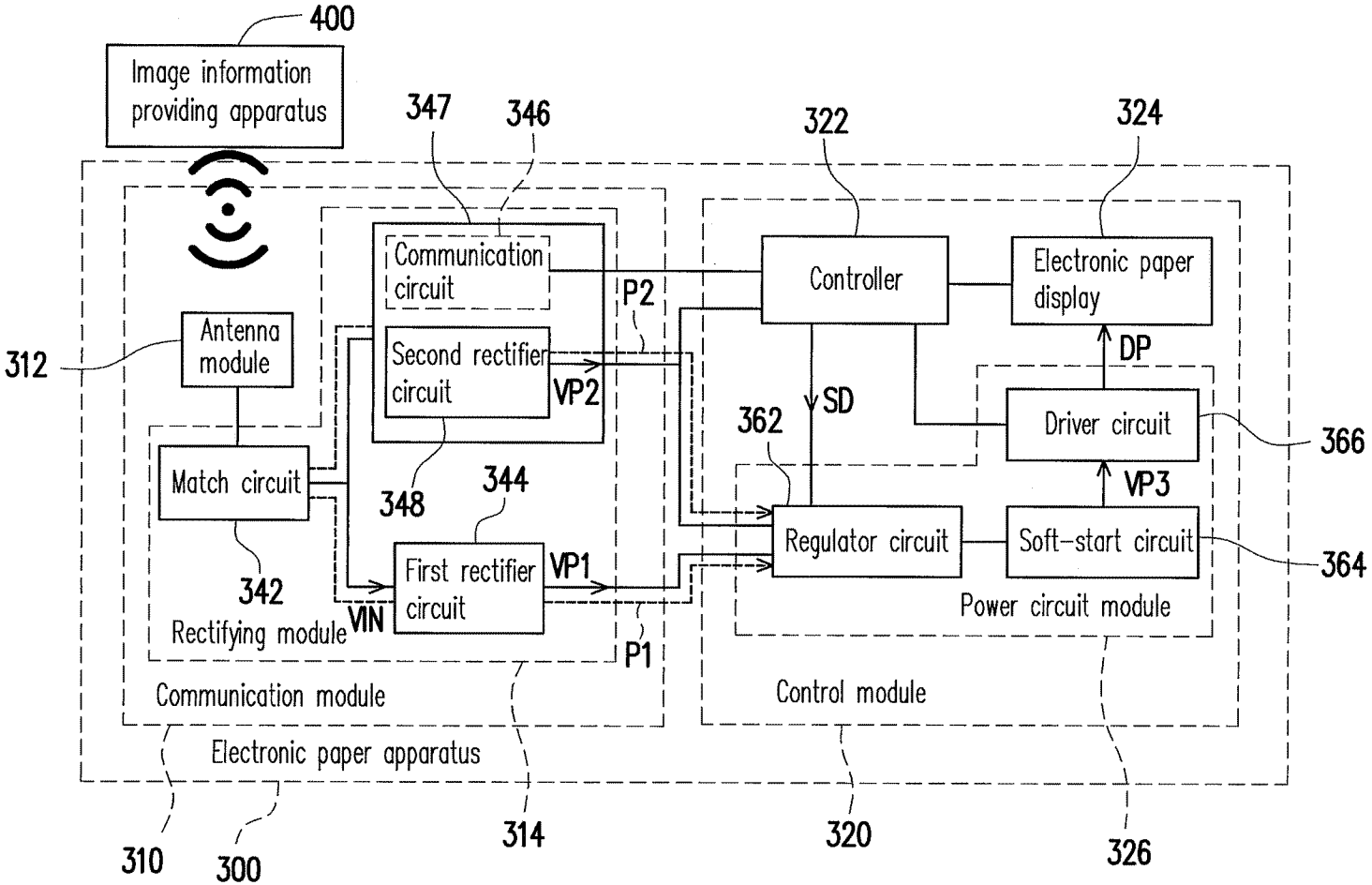
FIG. 3 is a schematic diagram illustrating an electronic paper apparatus and an image information providing apparatus according to another embodiment of the invention.

FIG. 3 is a schematic diagram illustrating an electronic paper apparatus and an image information providing apparatus according to another embodiment of the invention. Referring to FIG. 3, an electronic paper apparatus 300 and an image information providing apparatus 400 of the present embodiment are similar to the electronic paper apparatus 100 and the image information providing apparatus 200 of FIG. 1, but FIG. 3 further discloses circuitry block of each of components inside the electronic paper apparatus 300.

Specifically, in the present embodiment, a rectifying module 314 includes a match circuit 342, a communication circuit 346, a first rectifier circuit 344 and a second rectifier circuit 348. In the present exemplary embodiment, the first rectifier circuit 344 is disposed on a first signal transmission path P1. The first rectifier circuit 344 is electrically connected to an antenna module 312 via the match circuit 342, and electrically connected to a control module 320. The first rectifier circuit 344 is configured to transmit a power voltage VP1 less than a threshold voltage to the control module 320. In this example, the first rectifier circuit 344 includes, for example, the AC-to-DC converter, which is configured to convert the electrical signal VIN in microwave form into the power voltage VP1 in DC form to be outputted to control module 320. The second rectifier circuit 348 is disposed on a second signal transmission path P2. The second rectifier circuit 348 is also electrically connected to the antenna module 312 via the match circuit 342, and electrically connected to the control module 320. The second rectifier circuit 348 is configured to transmit a power voltage VP2 greater than or equal to the threshold voltage to the control module 320. In the present exemplary embodiment, settings of the threshold voltage are determined according to a rectifying capability of the second rectifier circuit 348, for example. For instance, after the power voltage inputted to the second rectifier circuit 348 is rectified, if the second rectifier circuit 348 is capable of providing a voltage value above the threshold voltage to a next-stage circuit, the threshold voltage may be set as said voltage value of the second rectifier circuit 348. In the present embodiment, the power voltage VP1 less than the threshold voltage is, for example, generated by the antenna module 312 by sensing the electrical signal VIN with less signal value which is provided by, for example, the handheld electronic apparatus, but the invention is not limited thereto. The power voltage VP2 is, for example, generated by the antenna module 312 by sensing the electrical signal VIN with greater signal value which is provided by, for example, the card reader, but the invention is not limited thereto.

In the present embodiment, the electrical signal VIN is sensed and received by the antenna module 312. Accordingly, the match circuit 342 is disposed in between the three of the antenna module 312, a communication circuit block 347 and the first rectifier circuit 344, and configured to regulate impedances of the communication circuit block 347 and the first rectifier circuit 344 so as to achieve an impedance matching between the communication circuit block 347 and the first rectifier circuit 344. The communication circuit 346 is electrically connected to the antenna module 312 via the match circuit 342, and electrically connected to the control module 320. The communication circuit 346 is configured to establish the communication connection with the control module 320 during the second period T2 of the work period TW, and generate the driving voltage DP according to the power voltage VP. In an embodiment, the communication circuit 346 includes, for example, a communication interface, and the second rectifier circuit 348 may be integrated with the communication interface to form the communication circuit block 347, for example, but the invention is not limited thereto. In other words, in the present embodiment, the communication circuit block 347 includes the communication circuit 346 and the second rectifier circuit 348.

Further, in the present embodiment, the controller 322 receives the image information provided by the image information providing apparatus 400 from the communication circuit 346 by using a signal transmission interface of a first type, for example. The controller 322 transmits the image information provided by the image information providing apparatus 400 to the electronic paper display 324 by using a signal transmission interface of a second type, for example. In the present embodiment, the signal transmission interface of the first type is, a serial communication bus of the Inter-Integrated Circuit (I2C) and the signal transmission interface of the second type is of the Serial Peripheral Interface Bus (SPI), but the invention is not limited thereto.

On the other hand, in the present embodiment, the power circuit module 326 includes a regulator circuit 362, a soft-start circuit 364 and a driver circuit 366. In the present exemplary embodiment, the regulator circuit 362 is electrically connected to the communication module 310, the controller 322, the soft-start circuit 364 and the electronic paper display 324. The regulator circuit 362 is configured to receive the power voltage VP1 outputted by the first rectifier circuit 344 and the power voltage VP2 outputted by the second rectifier circuit 348. In the present embodiment, the controller 322 may, for example, control the regulator circuit 362 to select to output the power voltage VP1 less than the threshold voltage or the power voltage VP2 greater than or equal to the threshold voltage for the soft-start circuit 364 and the driver circuit 366, so as to drive the electronic paper display 324 to display the image information. In the present exemplary embodiment, the controller 322 is capable of converting the analog signal into the digital signal. Therefore, the controller 322 converts, for example, the analog signal into a digital signal SD, and controls the regulator circuit 362 to select to output the power voltage VP1 or the power voltage VP2 to the soft-start circuit 364 by using the digital signal SD. In the present embodiment, the analog signal is, for example, the power voltages VP1 or VP2, which are particularly limited in the invention.

Subsequently, in the present embodiment, the soft-start circuit 364 is coupled between the regulator circuit 362 and the driver circuit 366. The soft-start circuit 364 is configured to receive the power voltage VP1 less than the threshold voltage or the power voltage VP2 greater than or equal to the threshold voltage. After receiving the power voltages VP1 or VP2, the soft-start circuit 364 is configured to lower an inrush current in the power voltages VP1 or VP2 so as to output a power voltage VP3 in which the inrush current is lowered to the driver circuit 366. The driver circuit 366 is electrically connected to the soft-start circuit 364, and configured to receive the power voltage VP3 and generate the driving voltage DP for driving the electronic paper display 324 to display the image information.

Therefore, in the present embodiment, based on the different types of the image information providing apparatus 400 for providing the electrical signal VIN, a size of the power voltage generated through sensing of the antenna module 312 may also be different. As in response to different applications, the controller 322 of the present exemplary embodiment may, for example, control the regulator circuit 362 to select to output the power voltage VP1 less than the threshold voltage or the power voltage VP2 greater than or equal to the threshold voltage for the soft-start circuit 364 and the driver circuit 366, so as to drive the electronic paper display 324 to display the image information.

Figure 4:
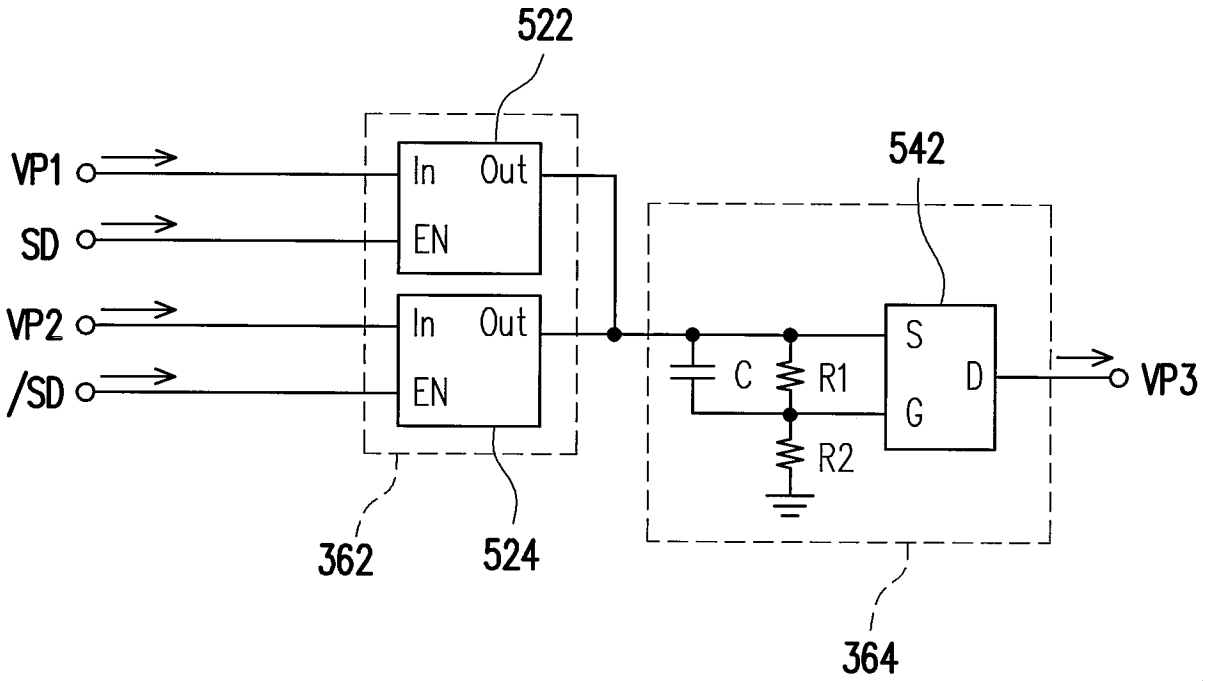
FIG. 4 is a schematic diagram illustrating a regulator circuit and a soft-start circuit according to an embodiment of the invention.

FIG. 4 is a schematic diagram illustrating a regulator circuit and a soft-start circuit according to an embodiment of the invention. In the present embodiment, the regulator circuit 362 includes, for example, latch circuits 522 and 524 which are implemented by two digit logic gates. The latch circuits 522 and 524 are configured to receive the power voltages VP1 and VP2 respectively. The controller 322 determines whether to control the latch circuits 522 and 524 to output the power voltages VP1 and VP2 to the soft-start circuit 364 by using the digital signal SD. For instance, if the digital signal SD is "1" or at the high level, the latch circuit 522 is enabled to output the power voltage VP1. Otherwise, if the digital signal SD is "0" or at the low level, the latch circuit 522 is disabled without outputting the power voltage VP1. Similarly, if the digital signal SD is "1" or at the high level, the latch circuit 524 is enabled to output the power voltage VP2. Otherwise, if the digital signal SD is "0" or at the low level, the latch circuit 524 is disabled without outputting the power voltage VP2. In the case where only one of the power voltages VP1 and VP2 is selected for outputting, the latch circuits 522 and 524 will not be enabled at the same time. Herein, a digital signal/SD refers to an inverted signal of the digital signal SD. In this example, because the inrush current may exist in the power voltages VP1 and VP2 outputted by the latch circuits 522 and 524, the soft-start circuit 364 may be coupled thereto for lowering the inrush current.

In the present embodiment, the soft-start circuit 364 includes a soft-start circuit body (that is implemented by resistors R1 and R2 and a capacitor C) and a switch element 542. A control terminal G of the switch element 542 is coupled to a terminal of the resistor R2, and determines whether to output the power voltage VP3 according to a voltage on the terminal. An input terminal S of the switch element 542 is configured to receive the power voltages VP1 or VP2 in which the inrush current is lowered by the soft-start circuit body, and an output terminal D is configured to output the power voltage VP3 and transmit the power voltage VP3 to the driver circuit 366.

It should be noted that, the embodiment of the regulator circuit 362 and the soft-start circuit 364 as illustrated in FIG. 4 is merely an example, which is not intended to limit the invention.

Figure 5:
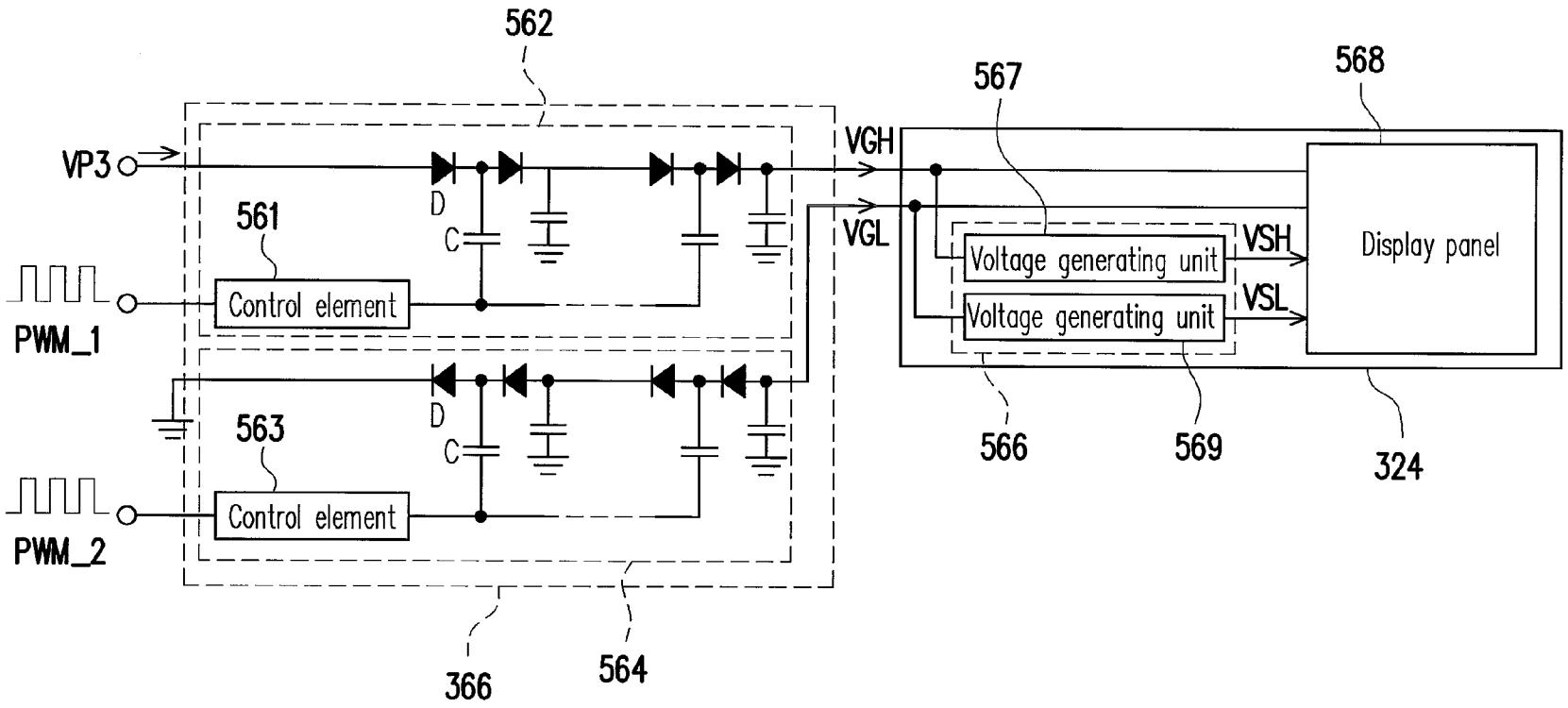
FIG. 5 is a schematic diagram illustrating a driver circuit and an electronic paper display according to an embodiment of the invention.

FIG. 5 is a schematic diagram illustrating a driver circuit and an electronic paper display according to an embodiment of the invention. In the present embodiment, the driver circuit 366 includes, for example, two driving channels 562 and 564 configured to respectively generate gate voltages VGH and VGL for driving the electronic paper display 324. Specifically, the driving channel 562 includes, for example, a plurality of diodes D coupled in series, a plurality of capacitors C coupled in parallel and a control element 561. Herein, an anode of a first diode D among the diode string of the driving channel 562 is coupled to the power voltage VP3. The control element 561 receives a control signal PWM_1 from the controller 322 in order to control a charging/discharging of its capacitors C. Similarly, the driving channel 564 includes, for example, a plurality of diodes D coupled in series, a plurality of capacitors C coupled in parallel and a control element 563. Herein, a cathode of a last diode D among the diode string of the driving channel 562 is coupled to a ground voltage. The control element 563 receives a control signal PWM_2 from the controller 322 in order to control a charging/discharging of its capacitors C. Accordingly, the driver circuit 366 is controlled by the controller 322 and generates the gate voltages VGH and VGL in the driving voltage DP according to the power voltage VP3, so as to drive the electronic paper display 324 to display the image information.

In the present embodiment, the electronic paper display 324 includes, for example, a voltage generating unit 566 and a display panel 568. The voltage generating unit 566 includes, for example, two voltage generating circuits 567 and 569. The voltage generating circuits 567 and 569 are, for example, configured to receive the gate voltages VGH and VGL outputted from the driving channels 562 and 564 respectively, and accordingly generate source voltages VSH and VSL. The voltage generating unit 566 cooperates with the driving channels 562 and 564 to drive the display panel 568 to display the image information by using the source voltages VSH and VSL. In the present embodiment, the display panel 568 is, for example, an electronic paper display panel.

It should be noted that, embodiment of the driver circuit 366 and the electronic paper display 324 as illustrated in FIG. 5 is merely an example, which is not intended to limit the invention.

Figure 6:
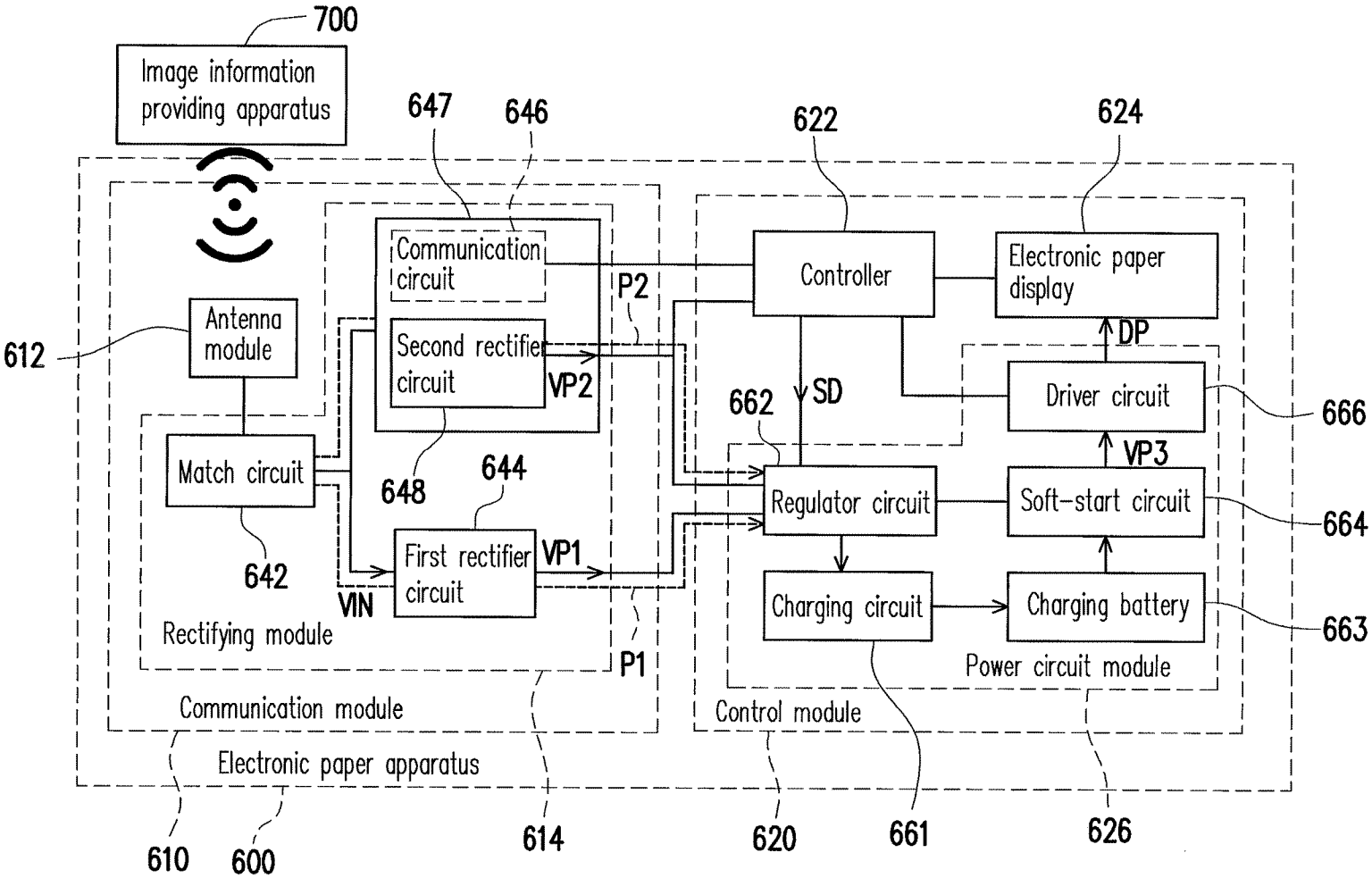
FIG. 6 is a schematic diagram illustrating an electronic paper apparatus and an image information providing apparatus according to another embodiment of the invention.

FIG. 6 is a schematic diagram illustrating an electronic paper apparatus and an image information providing apparatus according to another embodiment of the invention. An electronic paper apparatus 600 and an image information providing apparatus 700 of the present embodiment are similar to the electronic paper apparatus 300 and the image information providing apparatus 400 of FIG. 3, and a major difference between the two is that a power circuit module 626 further includes a charging circuit 661 and a charging battery 633. Specifically, the charging circuit 661 is electrically connected to a regulator circuit 662 and the charging battery 663. The charging circuit 661 is configured to receive the power voltages VP1 or VP2, and stores the power voltages VP1 or VP2 to the charging battery 663. The charging battery 663 is electrically connected to the regulator circuit 662 via the charging circuit 661, and configured to store the power voltage VP1 or VP2 outputted by the regulator circuit 662 for the soft-start circuit. In the present embodiment, the charging circuit 661 may manage a charging/discharging of the charging battery 663 according to a status of the charging battery 663 for storing electrical energy. The charging circuit 661 may, for example, provide functions of an over-current protection, an over-voltage protection or an over-heat protection for the charging battery 663, but the invention is not limited thereto.

Figure 7:
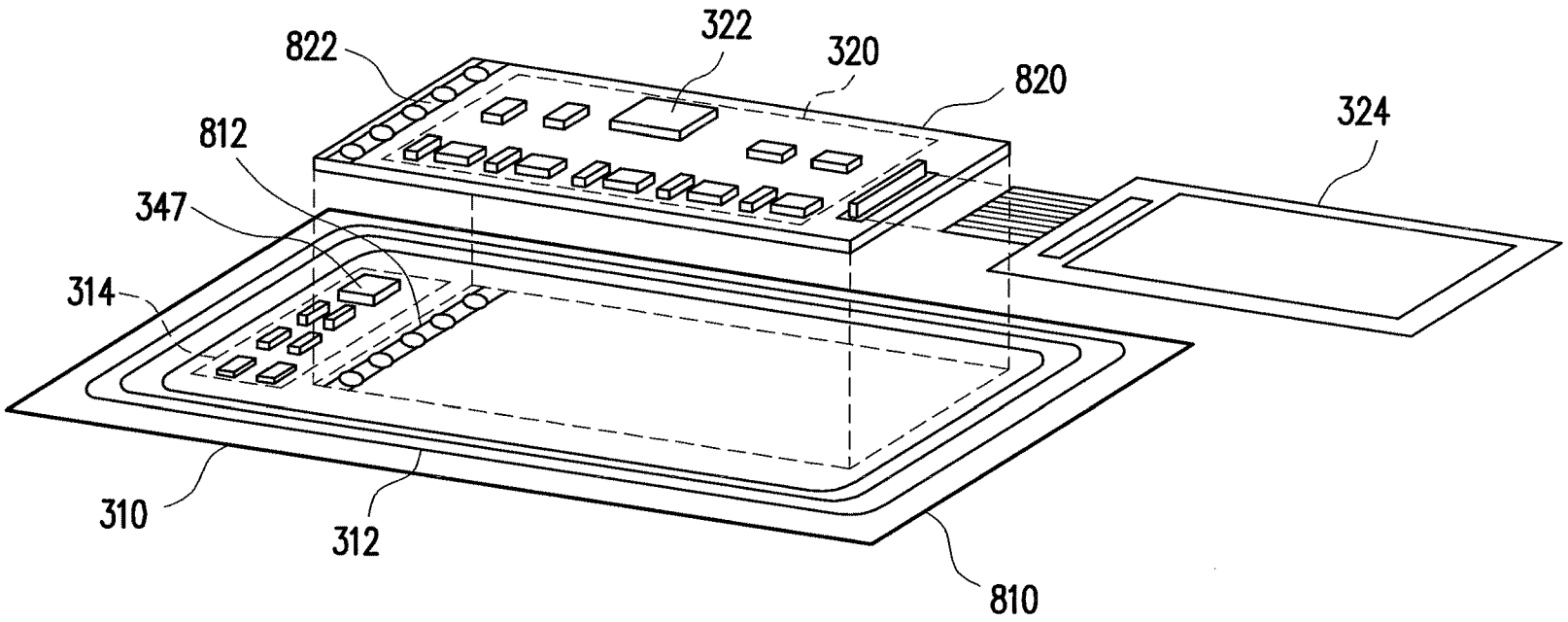
FIG. 7 is a schematic diagram illustrating a combination of a communication module and a control module according to an embodiment of the invention.

FIG. 7 is a schematic diagram illustrating a combination of a communication module and a control module according to an embodiment of the invention. Take electronic paper apparatus 300 of FIG. 3 as an example, in the present embodiment, the communication module 310 and the control module 320 are, for example, disposed on a first substrate 810 and a second substrate 820 respectively, which are two different substrates and separable from each other. The communication module 310 and the control module 320 are electrically connected to each other through a connector 812 on the first substrate 810 and a connector 822 on the second substrate 820, for example. However, the invention is not limited thereto. In another embodiment, the communication module and the control module may also be integrated on one substrate and inseparable from each other.

Figure 8:
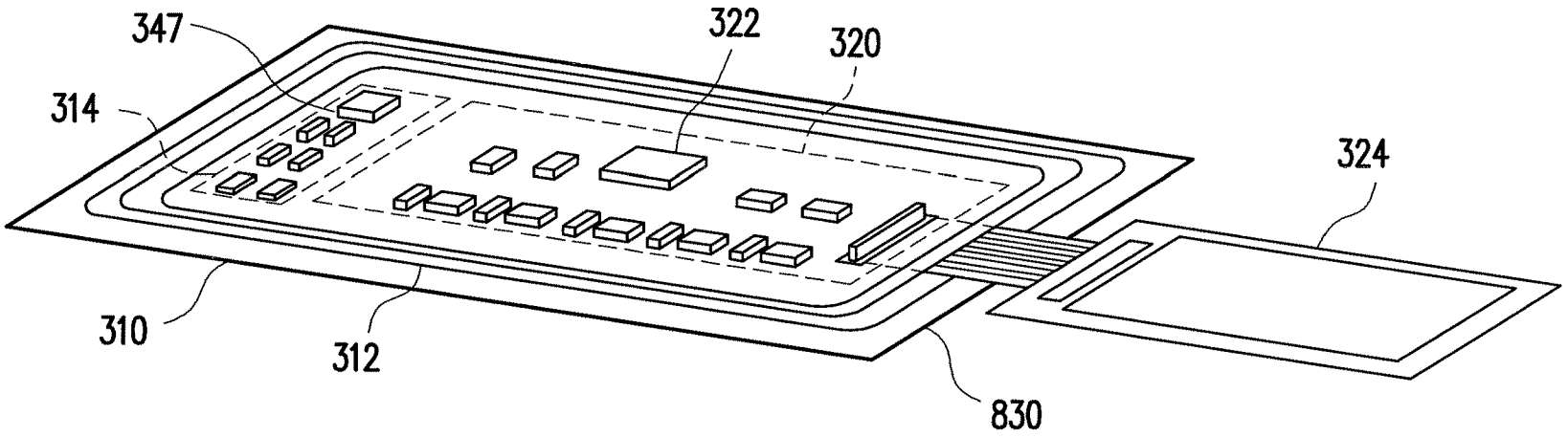
FIG. 8 is a schematic diagram illustrating a combination of a communication module and a control module according to another embodiment of the invention.

FIG. 8 is a schematic diagram illustrating a combination of a communication module and a control module according to another embodiment of the invention. In the present embodiment, the communication module 310 and the control module 320 are both, for example, disposed on a third substrate 830. Accordingly, in this example, the communication module 310 and the control module 320 are integrated on the same substrate and inseparable from each other.

In addition, although a combination of the communication module and the control module illustrated in FIG. 7 and FIG. 8 simply takes the electronic paper apparatus 300 of FIG. 3 as an example, enough teaching, suggestion, and implementation illustration for combinations of the electronic paper apparatuses 300 and 600 in FIG. 1 and FIG. 6 can be obtained from the embodiments in FIG. 7 to FIG. 8, thus related descriptions thereof are not repeated hereinafter.

Figure 9:
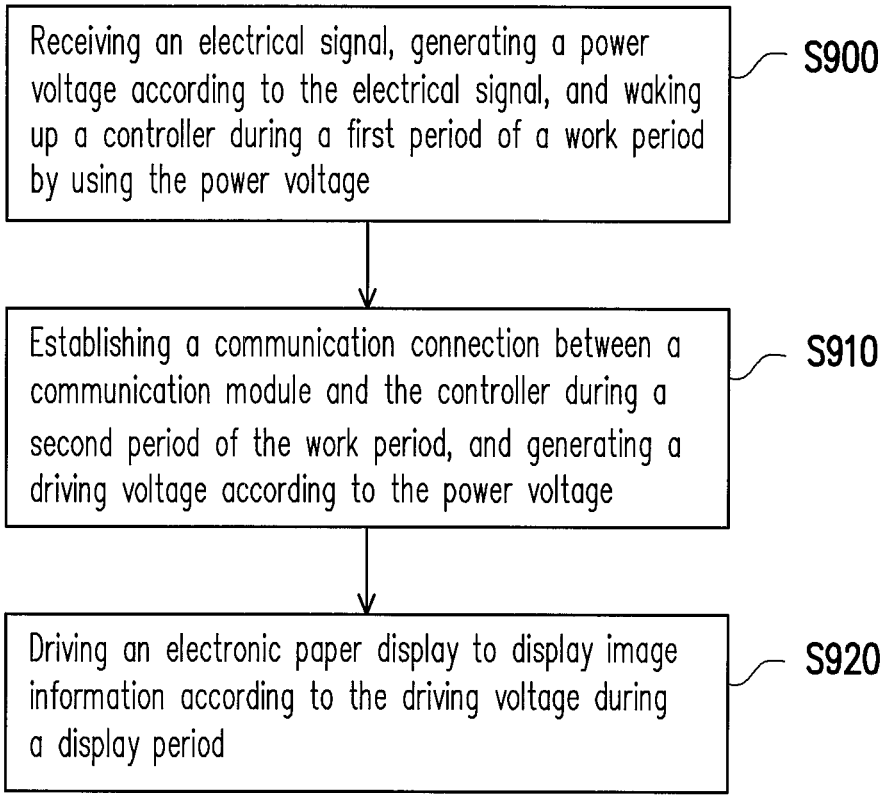
FIG. 9 is a flowchart illustrating steps in a driving method of an electronic paper apparatus according to an embodiment of the invention.

FIG. 9 is a flowchart illustrating steps in a driving method of an electronic paper apparatus according to an embodiment of the invention. Referring to FIG. 1 and FIG. 9, the driving method of the electronic paper apparatus of the present embodiment may be applied to, for example, the electronic paper apparatus 100 of FIG. 1, but the invention is not limited thereto. In step S900, the electronic paper apparatus 100 receives the electrical signal VIN, generates the power voltage VP according to the electrical signal VIN, and wakes up the controller 122 during the first period T1 of the work period TW by using the power voltage VP. Subsequently, in step S910, the controller 122 establishes the communication connection with the communication module 110 during the second period T2 of the work period TW, and generates the driving voltage DP according to the power voltage VP. Thereafter, in step S920, the electronic paper display 124 is driven to display the image information according to the driving voltage DP during the display period TD. In the present embodiment, the first period T1 and the second period T2 are two continuous time intervals forming the work period TW, as shown by FIG. 2. Further, in the present embodiment, based on the different types of the image information providing apparatus 200 for providing the electrical signal VIN, a size of the power voltage VP may also be different. As in response to different applications, the driving method of the present embodiment is capable of selecting to output the power voltage less than the threshold or the power voltage greater than or equal to the threshold voltage to drive the electronic paper display 124 to display the image information.

In addition, sufficient teaching, suggestion, and implementation illustration regarding the driving method of the electronic paper apparatus of the embodiments of the invention may be obtained from the above embodiments depicted in FIG. 1 to FIG. 8, and thus related description thereof is not repeated hereinafter.

In summary, according to the embodiments of the invention, when the electronic paper apparatus enters the work period by using the power voltage, the level of the power voltage is changed from the first voltage level to wake up the controller, so as to reduce the time consumed for updating the image information of the electronic paper display. In addition, in the embodiments of the invention, the electronic paper apparatus is capable of selecting the power voltage less than the threshold or the power voltage greater than or equal to the threshold voltage to drive the electronic paper display to display the image information.

Although the present disclosure has been described with reference to the above embodiments, it will be apparent to one of ordinary skill in the art that modifications to the described embodiments may be made without departing from the spirit of the disclosure. Accordingly, the scope of the disclosure will be defined by the attached claims and not by the above detailed descriptions.

What is claimed is:

1. An electronic paper apparatus, comprising:

a communication module, configured to receive an electrical signal, generate a power voltage according to the electrical signal, transmit one of the power voltage less than a threshold voltage or the power voltage greater than or equal to the threshold voltage to a control module electrically connected to the communication module, and wake up a controller during a first period of a work period by using the power voltage, wherein the power voltage less than the threshold voltage is transmitted to the control module via a first signal transmission path, and the power voltage greater than the threshold voltage is transmitted to the control module via a second signal transmission path; and the control module comprising the controller, an electronic paper display, and a power circuit module comprising a regulator circuit and a driver circuit, wherein the regulator circuit electrically connected to the communication module, the controller and the electronic paper display, and the driver circuit electrically connected to the regulator circuit, the controller and the electronic paper display, the control module being configured to establish a communication connection with the communication module during a second period of the work period, the regulator circuit being configured to select to output the power voltage less than the threshold voltage or the power voltage greater than or equal to the threshold voltage, and the driver circuit being configured to generate a driving voltage according to the power voltage less than the threshold voltage or the power voltage greater than or equal to the threshold voltage so as to drive the electronic paper display to display image information during a display period, wherein the first period and the second period are two continuous time intervals forming the work period.

2. The electronic paper apparatus of claim 1, wherein the power voltage is maintained at a first voltage level before the work period, and the power voltage is changed to a second voltage level to wake up the controller when the electrical signal is transmitted to the electronic paper apparatus by an image information providing apparatus.

3. The electronic paper apparatus of claim 2, wherein a time length for maintaining the power voltage at the first voltage level is greater than a time length of the first period.

4. The electronic paper apparatus of claim 1, wherein the communication module comprises:

an antenna module, configured to electrically connect to an image information providing apparatus to receive the electrical signal provided by the image information providing apparatus; and a rectifying module, electrically connected to the antenna module, and configured to rectify the electrical signal in order to generate the power voltage to be provided to the control module.

5. The electronic paper apparatus of claim 4, wherein the rectifying module comprises:

a first rectifier circuit, electrically connected to the antenna module and the control module, disposed on the first signal transmission path, and configured to transmit the power voltage less than the threshold voltage to the control module; and a second rectifier circuit, electrically connected to the antenna module and the control module, disposed on the second signal transmission path, and configured to transmit the power voltage greater than or equal to the threshold voltage to the control module.

6. The electronic paper apparatus of claim 5, wherein the rectifying module further comprises:

a communication circuit, electrically connected to the antenna module and the control module, and configured to establish the communication connection with the control module during the second period of the work period, wherein the communication circuit and the second rectifier circuit form a communication circuit block; and a match circuit, electrically connected to the antenna module, the communication circuit block and the first rectifier circuit, and configured to regulate impedances of the first rectifier circuit and the communication circuit block to achieve an impedance matching between the first rectifier circuit and the communication circuit block.

7. The electronic paper apparatus of claim 1, wherein the power circuit module further comprises:

a soft-start circuit, electrically connected to the regulator circuit and the driver circuit, and configured to receive the power voltage less than the threshold voltage or the power voltage greater than or equal to the threshold voltage, lower an inrush current of the power voltage and output the power voltage in which the inrush current is lowered to the driver circuit.

8. The electronic paper apparatus of claim 1, wherein the controller converts an analog signal into a digital signal, and controls the regulator circuit to select to output the power voltage less than the threshold voltage or the power voltage greater than or equal to the threshold voltage by using the digital signal.

9. The electronic paper apparatus of claim 1, wherein the power circuit module further comprises:

a charging battery, electrically connected to the regulator circuit, and configured to store the power voltage outputted by the regulator circuit; and a charging circuit, electrically connected to the regulator circuit and the charging battery, and configured to receive the power voltage and store the power voltage to the charging battery.

10. The electronic paper apparatus of claim 1, wherein the communication module and the control module are integrated on one substrate and inseparable from each other.

11. The electronic paper apparatus of claim 1, wherein the communication module and the control module are disposed on different substrates and separable from each other.

12. A driving method of an electronic paper apparatus, wherein the electronic paper apparatus comprises a communication module and a control module, the control module comprises a controller, an electronic paper display, and a power circuit module comprising a regulator circuit and a driver circuit, wherein the regulator circuit electrically connected to the communication module, the controller and the electronic paper display, the driver circuit electrically connected to the regulator circuit, the controller and the electronic paper display, and the driving method comprises:

receiving an electrical signal, generating a power voltage according to the electrical signal, and waking up the controller during a first period of a work period by using the power voltage;

establishing a communication connection between the communication module and the controller during a second period of the work period, transmitting one of the power voltage less than a threshold voltage or the power voltage greater than or equal to the threshold voltage to the control module, and generating a driving voltage according to the power voltage, wherein the power voltage less than the threshold voltage is transmitted to the control module via a first signal transmission path, and the power voltage greater than the threshold voltage is transmitted to the control module via a second signal transmission path;

selecting to output the power voltage less than the threshold voltage or the power voltage greater than or equal to the threshold voltage by the regulator circuit, and driving the electronic paper display by the driver circuit to display image information according to the driving voltage less than the threshold voltage or the power voltage greater than or equal to the threshold voltage during a display period, wherein the first period and the second period are two continuous time intervals forming the work period.

13. The driving method of claim 12, wherein the electronic paper apparatus is configured to electrically connect to an image information providing apparatus, receive the electrical signal and generate the power voltage according to the electrical signal, and the step of waking up the controller during the first period of the work period by using the power voltage comprises:

sensing the electrical signal provided by the image information providing apparatus; and rectifying the electrical signal in order to generate the power voltage to be provided to the control module to thereby wake up the controller.

14. The driving method of claim 13, further comprising:

regulating impedances of the first signal transmission path and the second signal transmission path to achieve an impedance matching between the first signal transmission path and the second signal transmission path.

15. The driving method of claim 12, further comprising:

lowering an inrush current of the power voltage, and outputting the power voltage in which the inrush current is lowered to a driver circuit, wherein in the step of generating the driving voltage according to the power voltage, the driving voltage is generated according to the power voltage in which the inrush current is lowered.

16. The driving method of claim 12, further comprising: converting an analog signal into a digital signal; and selecting to output the power voltage less than the threshold voltage or the power voltage greater than or equal to the threshold voltage according to the digital signal.

17. The driving method of claim 12, further comprising: storing the power voltage to a charging circuit.

18. The driving method of claim 12, wherein maintaining the power voltage at a first voltage level before the work period, and changing the power voltage to a second voltage level to wake up the controller when the power voltage enters the work period.

19. The driving method of claim 18, wherein a time length for maintaining the power voltage at the first voltage level is greater than a time length of the first period.

* * * * *